US005157883A

United States Patent [19]

Meyer

[11] Patent Number: 5,157,883

[45] Date of Patent: Oct. 27, 1992

[54] METAL FRAMES

[76] Inventor: Allan Meyer, 45 Becky Avenue, North Rocks, New South Wales 2151, Australia

[21] Appl. No.: 521,137

[22] Filed: May 8, 1990

[30] Foreign Application Priority Data

May 8, 1989 [AU] Australia ..... PJ4059
Aug. 10, 1989 [AU] Australia ..... PJ5704

[51] Int. Cl.[5] ..... E04C 5/18

[52] U.S. Cl. ..... 52/357; 52/732; 52/712; 52/720; 52/696; 24/460

[58] Field of Search ..... 52/290, 241, 357, 358, 52/359, 353, 354, 355, 732, 731, 712, 696, 720, 243, 238.1, 490, 317, 729; 24/459, 460, 545, 546, 555, 563

[56] References Cited

U.S. PATENT DOCUMENTS 885,439 4/1908 Collins .
1,142,093 6/1915 Harp ..... 52/712
1,849,811 3/1932 Smiley, Jr. ..... 52/238.1
2,173,094 9/1939 Burson ..... 52/353
2,598,139 5/1952 Shea .
2,936,049 2/1952 Hovind .
3,232,018 4/1966 MacKean .
3,293,813 12/1966 Emmons et al. ..... 52/481
3,357,148 2/1967 Turner .
3,430,385 3/1969 Biro .
3,845,601 11/1974 Kostecky .
3,956,855 5/1976 Walker .
4,021,988 5/1977 Edeus et al. .
4,193,245 3/1980 Johnson .
4,263,764 3/1982 Wendt .
4,809,476 3/1989 Satchell .

FOREIGN PATENT DOCUMENTS 500773 2/1951 Belgium ..... 52/712
712813 7/1965 Canada .

*Primary Examiner*—Richard E. Chilcot, Jr.
*Assistant Examiner*—Robert Canfield
*Attorney, Agent, or Firm*—Ladas & Parry

[57] ABSTRACT

A wall frame structure consisting of wall plates and wall studs, which are formed of metal sheet, with the wall plate being provided with projections to engage the stud to aid in securing the stud in position, and the stud being reinforced by transversely extending ribs and reinforced apertures. A reinforcing bracket surrounds the stud and aids in securing the stud to the wall plate. There is further provided reinforcing clips which extend between the flanges of the stud to inhibit transverse movement of the flanges relative to each other, under loading.

6 Claims, 8 Drawing Sheets

FIG. 3
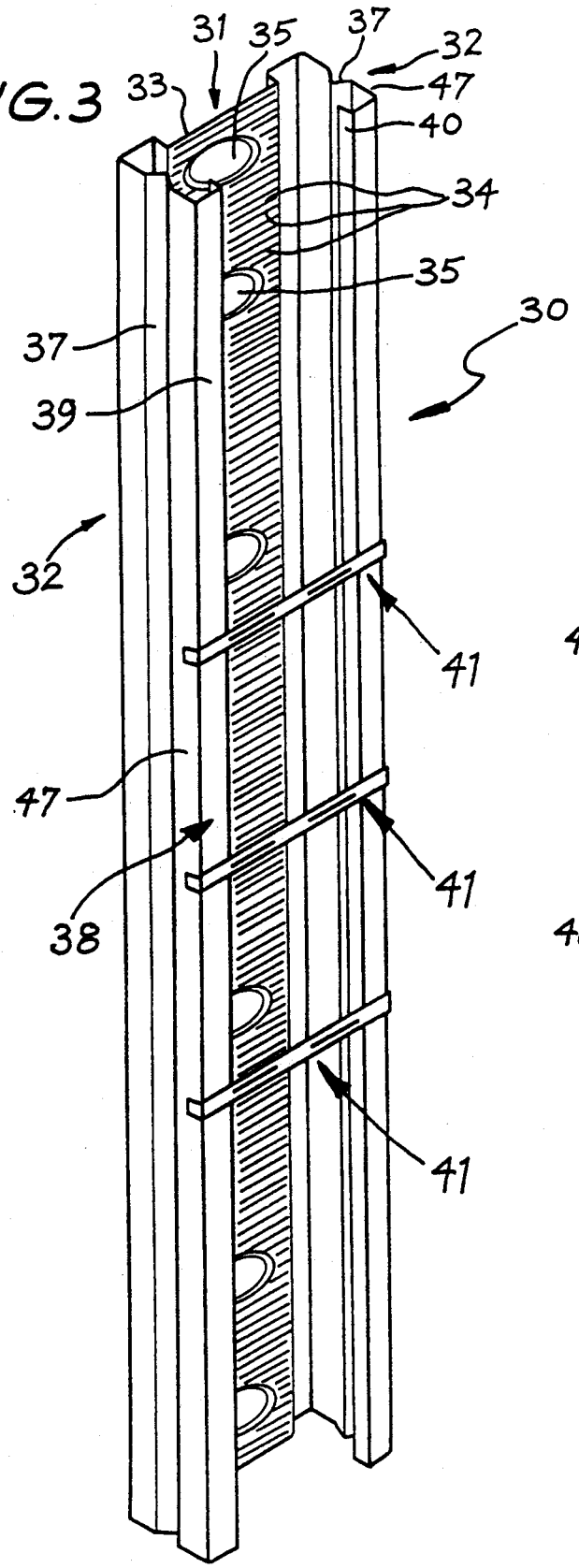
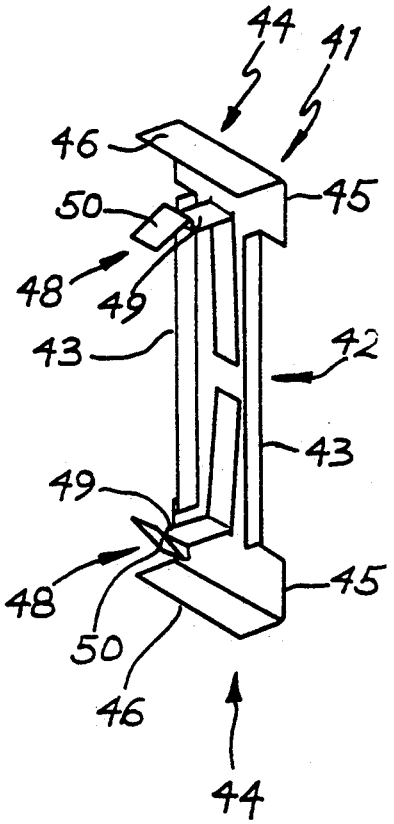
FIG. 4

FIG. 7
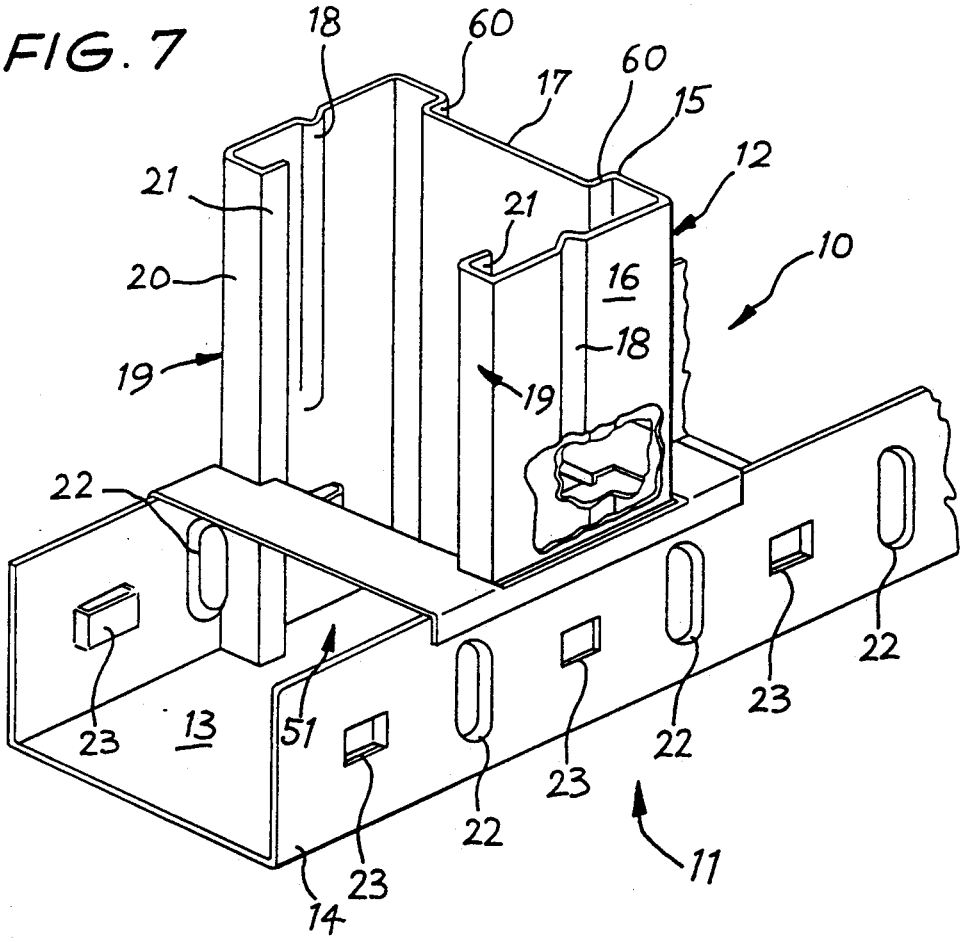
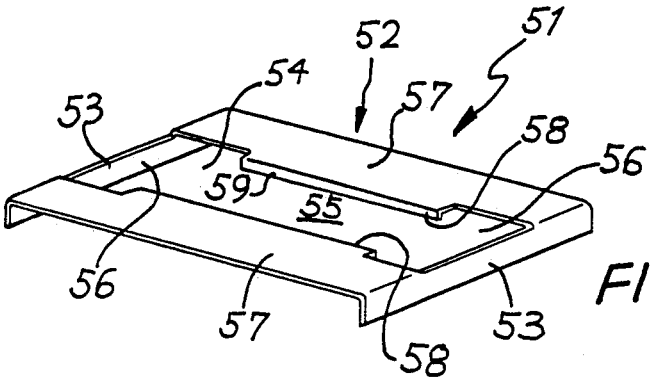
FIG. 8

METAL FRAMES

The present invention relates to wall frame structures and more particularly but not exclusively to domestic wall frame structures.

Metal wall studs, of a wall frame structure, need to be securely anchored to the bottom and top wall plates. In earthquake and cyclone areas, the joint between the studs and wall plates is particularly stressed.

Currently available metal wall frame structures that address the problem of earthquake shock, are particularly heavy and time consuming to install. Due to the metal used and the time taken to erect these structures, adds considerably to the cost of the structure.

A further problem associated with metal frame structures, is the buckling of the studs. Generally the studs consist of a rolled metal channel member of generally "C-shaped" transverse cross section so as to have a base and two longitudinally extending side flanges. In reducing the cost of manufacture of the wall studs, it is desirable to reduce the metal thickness. In so doing, this reduces the stress at which the side flanges will buckle. A similar problem exists in respect of the longitudinally extending base of the stud.

Shown in U.S. Pat. application Ser. No. 455,428 (PCT Application AU 88/00208) shows the use of clips to secure the wall stud to the wall plate, by engagement of the clip in eyelets of the plate. This particular arrangement, provides a secure attachment between the wall stud and plate, the arrangement can be improved upon by further inhibiting relative movement between the stud and plate.

It is the object of the present invention to provide a wall plate, adapted to engage a wall stud, to retain the wall stud in position.

There is firstly disclosed herein a metal wall plate to engage at least one wall stud, said plate consisting of a rolled metal channel member of generally "U-shaped" transverse cross section so as to have a longitudinally extending base and a pair of longitudinally extending side flanges, and wherein at least one of the side flanges is provided with a pair of longitudinally spaced projections extending toward the other flange, and between which the stud is located so as to be securely engaged thereby.

There is secondly disclosed herein a metal wall stud consisting of a rolled metal channel member of generally "C-shaped" transverse cross section so as to have a longitudinally extending base and a pair of longitudinally extending side flanges, and wherein said base is provided with a plurality of ribs which are longitudinally spaced and extend transversely of the stud.

There is further disclosed herein a metal wall stud consisting of a rolled metal channel member of generally "C-shaped" transverse cross section so as to have a longitudinally extending base and a pair of longitudinally extending side flanges, and wherein said base is provided with a plurality of longitudinally spaced apertures, and a reinforcing portion surrounding each of the apertures.

There is still further disclosed herein a clip for a metal wall stud, which wall stud consists of a rolled metal member of generally "C-shaped" transverse cross section so as to have a longitudinally extending base and a pair of longitudinally extending side flanges, said clip being adapted to extend between the side flanges to inhibit movement therebetween in a direction transverse of the wall stud, said clip comprising a central portion to extend generally between the flanges, a pair of clip ends, with each clip end being adapted to engage a respect one of the flanges, and wherein each clip end has a first abutment to engage its associated flange to inhibit transverse movement thereof in a direction away from the other flange, and a second abutment to inhibit transverse movement of the associated flange in a direction toward the other flange.

There is also disclosed herein a metal wall plate to engage at least one wall stud, said plate consisting of a rolled metal channel member of generally "U-shaped" transverse cross section so as to have a longitudinally extending base and a pair of longitudinally extending side flanges, said flanges having longitudinally extending edge portions, with each edge portion terminating with a longitudinally extending edge which is not facing in a direction normal to said base.

Preferably the above metal wall plate would have its edge portions generally horizontally extending, with each edge also horizontally facing. In this preferred construction, the edge portions would extend towards each other with the edges facing each other.

A preferred form of the present invention will now be described by way of example with reference to the accompanying drawings, wherein:

FIG. 3 is a schematic perspective view of a wall stud and clips employed therewith;

FIG. 4 is a schematic perspective view of one of the clips employed with the wall stud of FIG. 3;

FIG. 7 is a schematic perspective view of the junction illustrated in FIG. 1, further provided with a reinforcing bracket;

FIG. 8 is a schematic perspective view of the bracket employed in FIG. 7;

Figure 1:
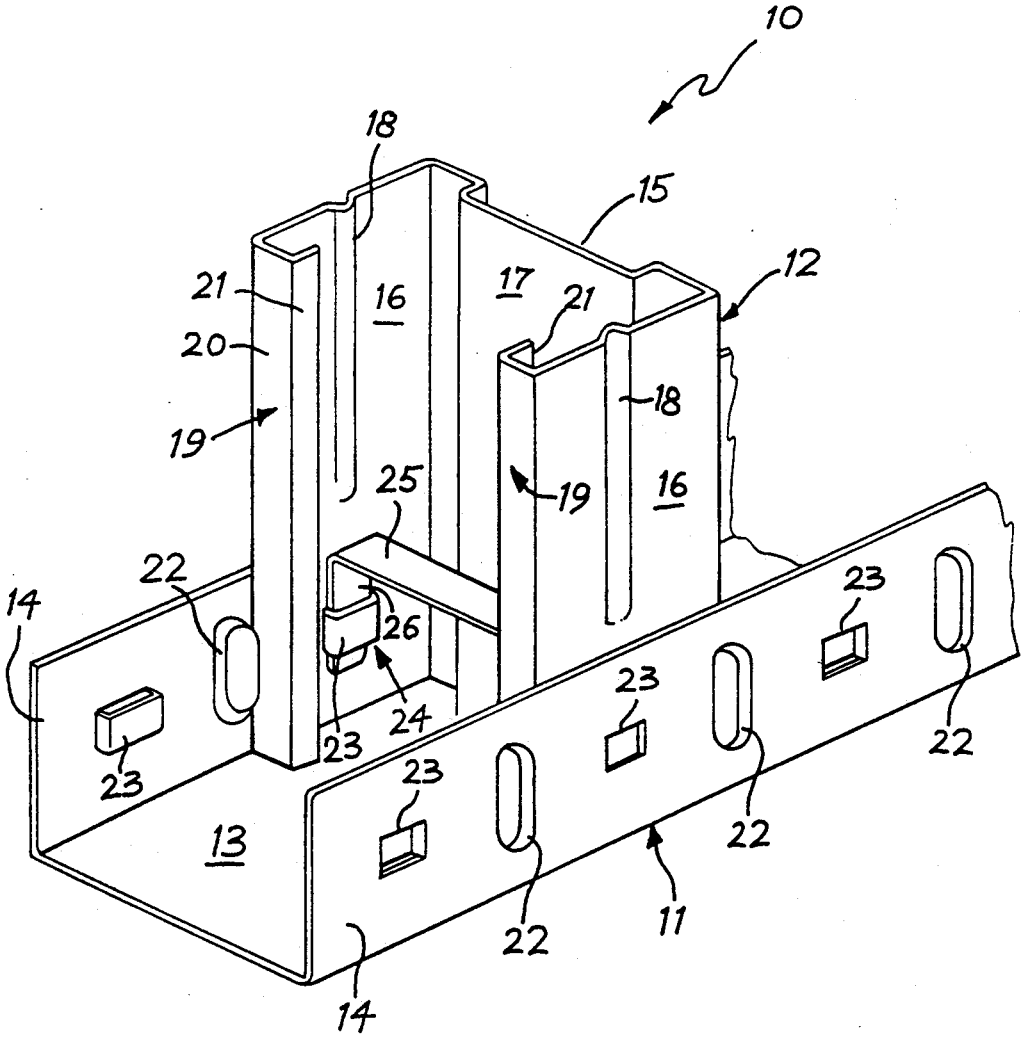
FIG. 1 is a schematic perspective view of the junction between a wall stud and wall plate of a metal wall frame structure.
Figure 2:
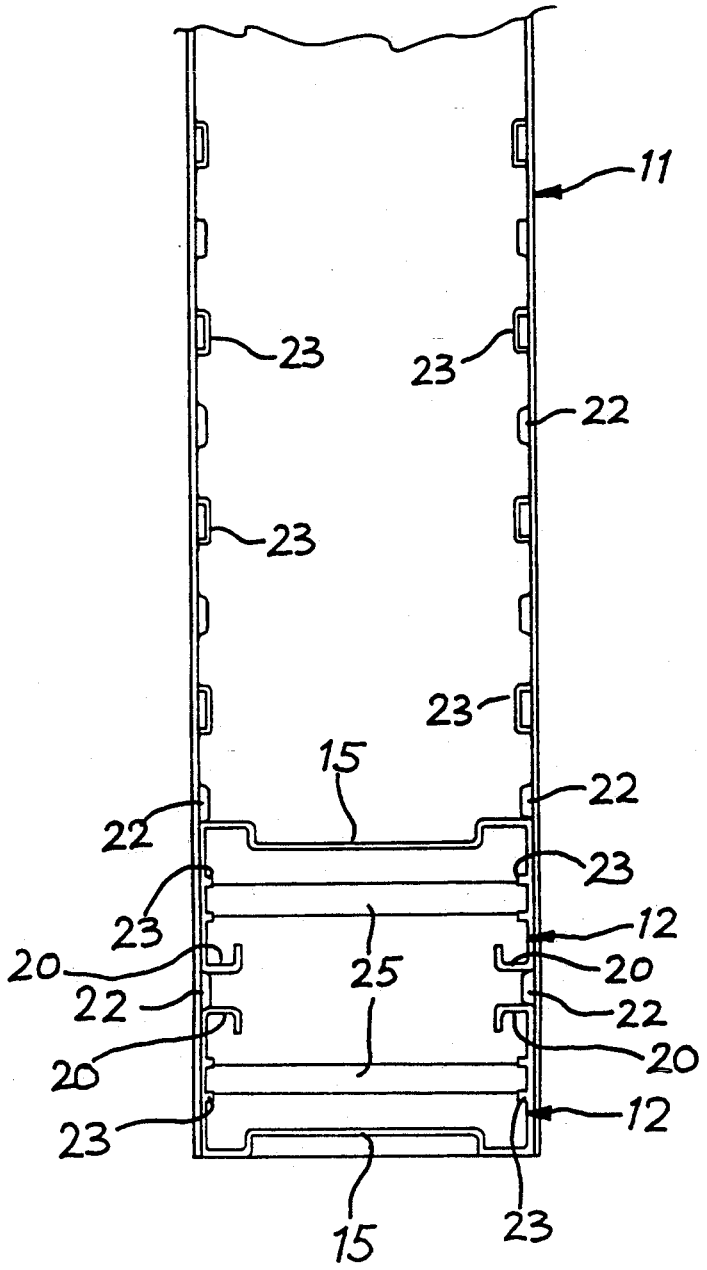
FIG. 2 is a schematic top plan view of a wall plate and a pair of wall studs joined in the manner as seen in FIG. 1.

In FIGS. 1 and 2 of the accompanying drawings there is schematically depicted a joint 10 between a bottom wall plate 11 and a wall stud 12 of a metal frame structure.

The bottom wall plate 11 is a rolled metal channel member of generally "U-shaped" transverse cross section so as to have a longitudinally extending base 13 and a pair of longitudinally extending side flanges 14. The stud 12 is also a rolled metal channel member provided with a longitudinally extending base 15 and a pair of longitudinally extending side flanges 16. The base 15 has a longitudinally extending central recess defining portion 17, while the side flanges 16 are each provided with a longitudinally extending rib 18. Each of the side flanges 16 terminates at its longitudinally extending edge with an "L-shaped" lip 19. Each lip 19 has a first longitudinally extending portion 20 generally parallel to the base 15, and a second longitudinally extending portion 21 extending generally parallel to the side flanges 16.

Each of the wall plate side flanges 14 is provided with a plurality of projections 22 which are equally longitudinally spaced, and project transversely towards the opposite flange 14. Also formed in the side flanges 14 are eyelets 23. The projections 22 and eyelets 23 are pressed from the side flanges 14 so as to be integrally formed therewith.

The lower end of the stud 12 is provided with a pair of apertures 24 located so that associated eyelets 23 may project therefrom. A clip 25, having a pair of legs 26, is then located so that the legs 26 pass through the eyelets 23 thereby securing the stud 12 in position. To further aid in securing the stud 12 in position, adjacent pairs of projections 22 are spaced by the width of the side flange 16, so as to abut the base 15 and first portion 20, as best seen in FIG. 2. The projections 22 hold the stud 12 against movement longitudinally of the plate 11. This particularly adopts the joint 10 for earthquake conditions.

Figures 5, 6:
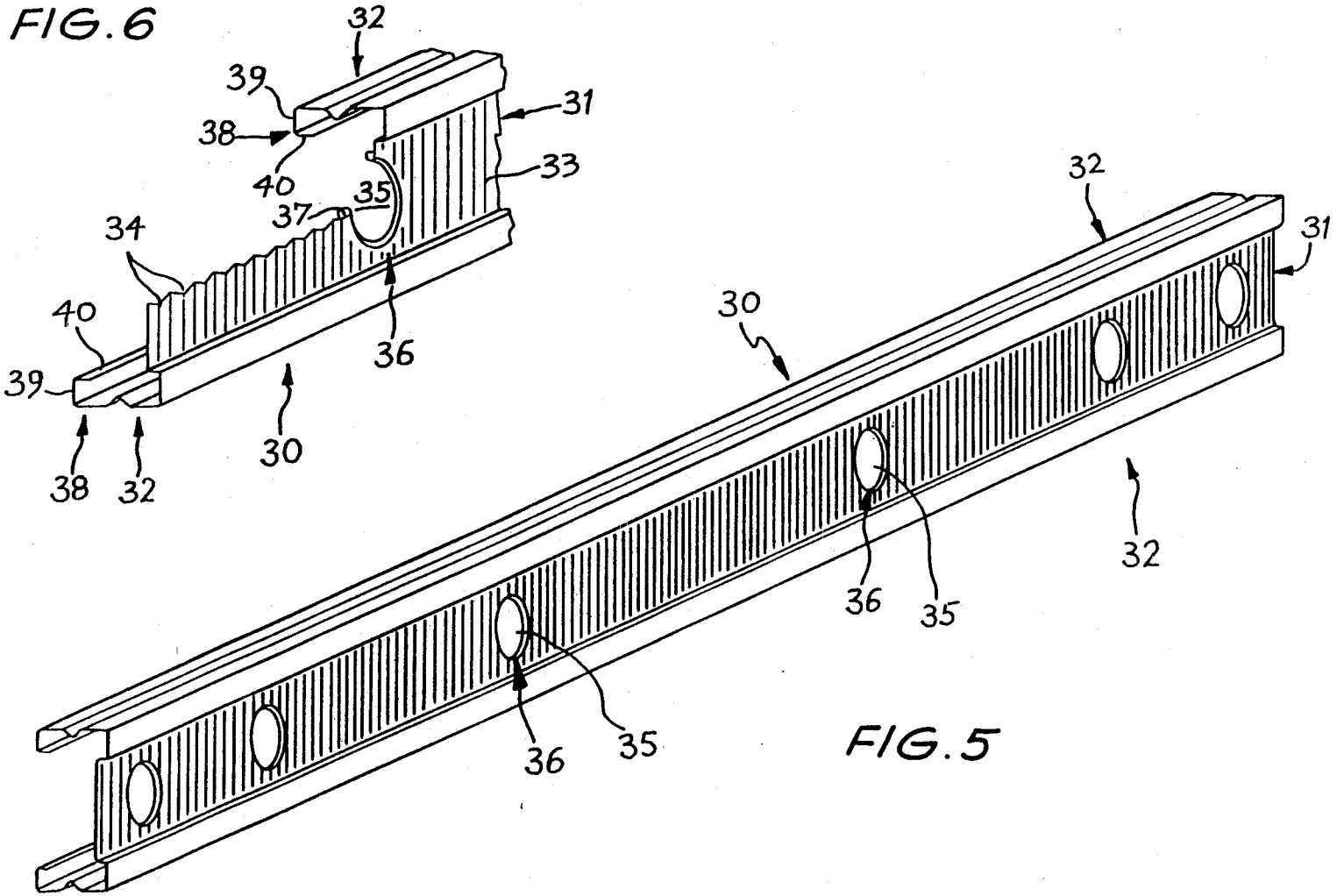
FIG. 5 is a schematic perspective view of the wall stud of FIG. 3.
FIG. 6 is a schematic part sectioned perspective view of the wall stud as shown in FIG. 5.
Figure 9:
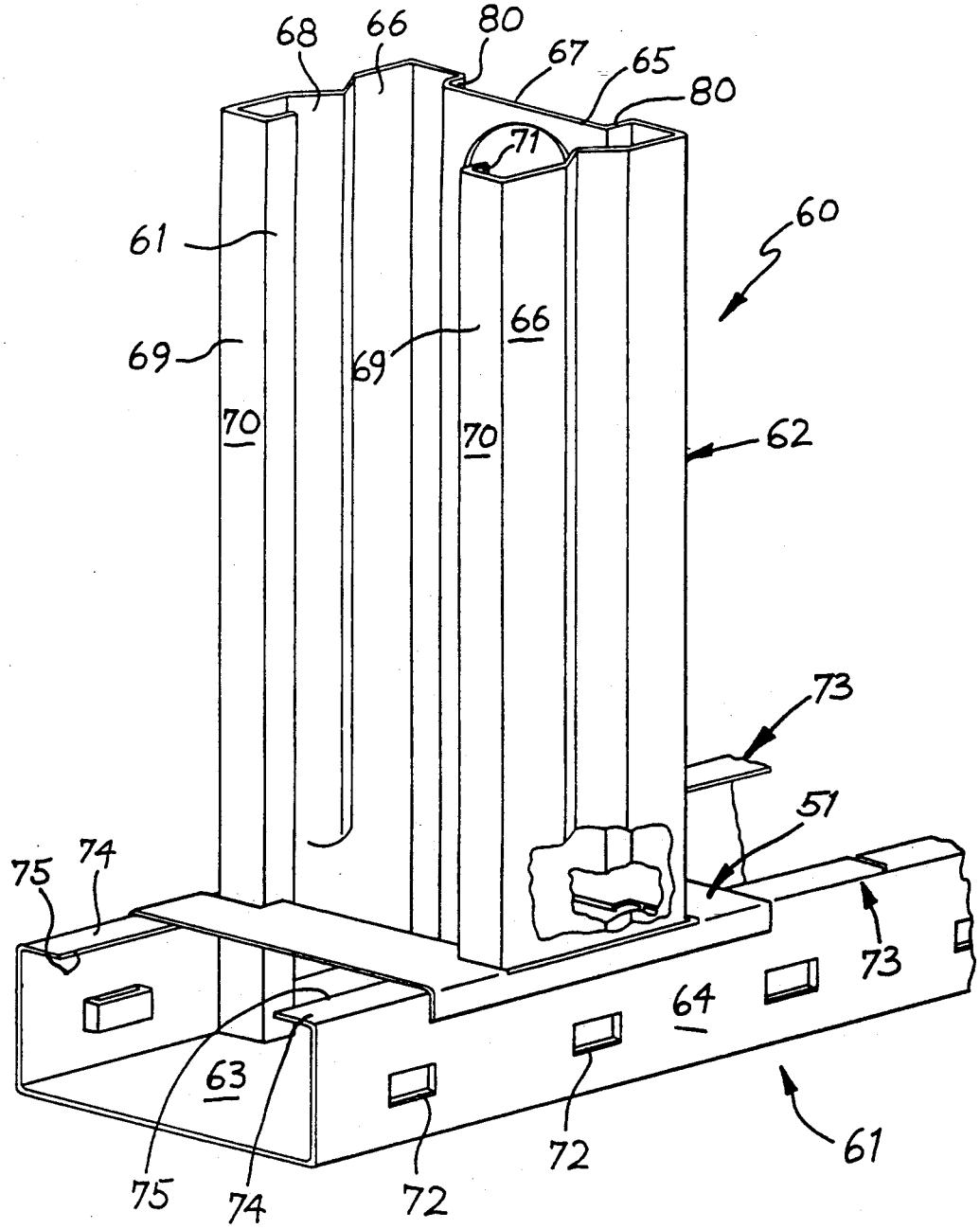
FIG. 9 is a schematic perspective view of the junction of a bottom wall plate and wall stud.
Figure 10:
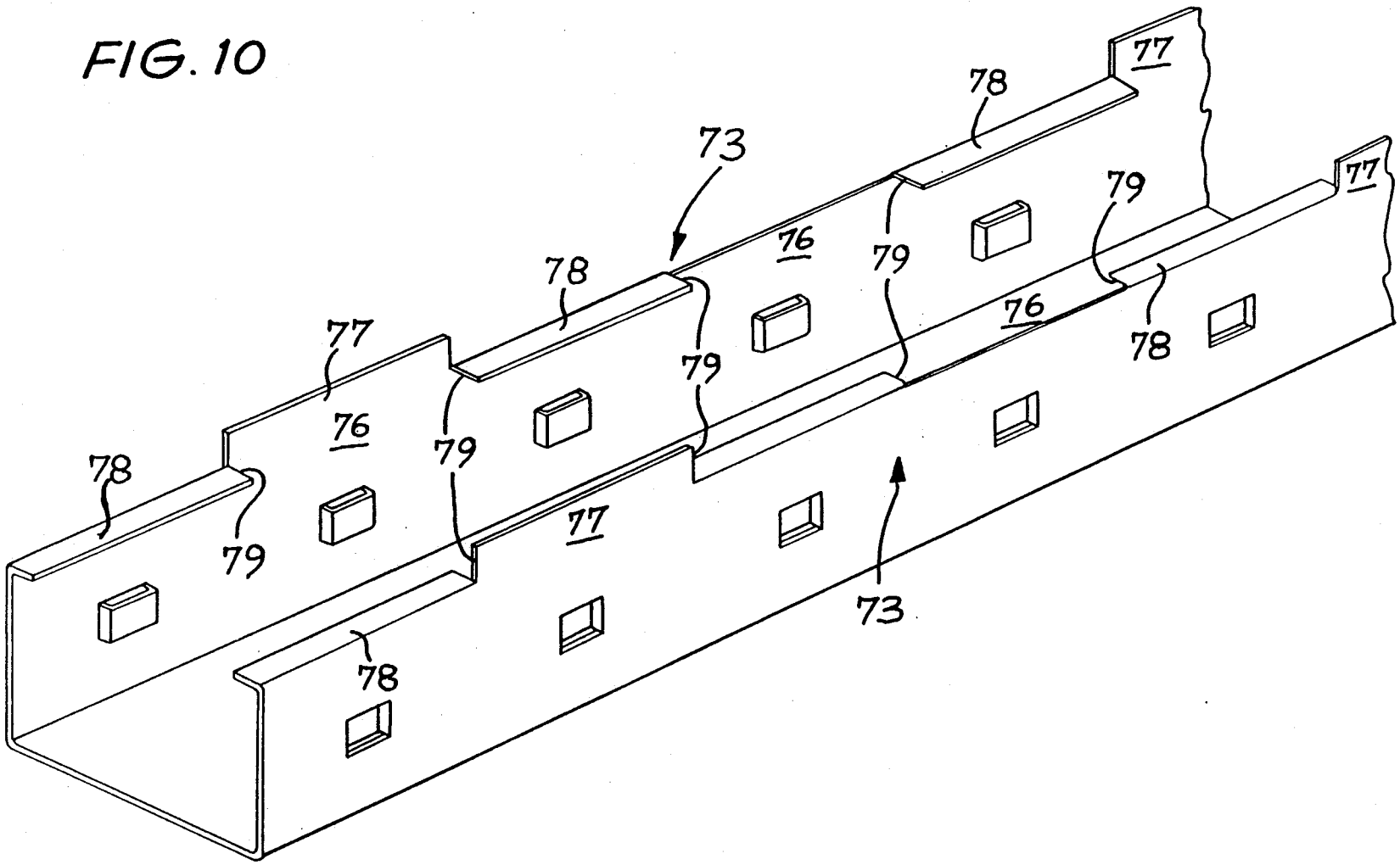
FIG. 10 is a schematic perspective view of the bottom wall plate of FIG. 9.
Figures 11, 12:
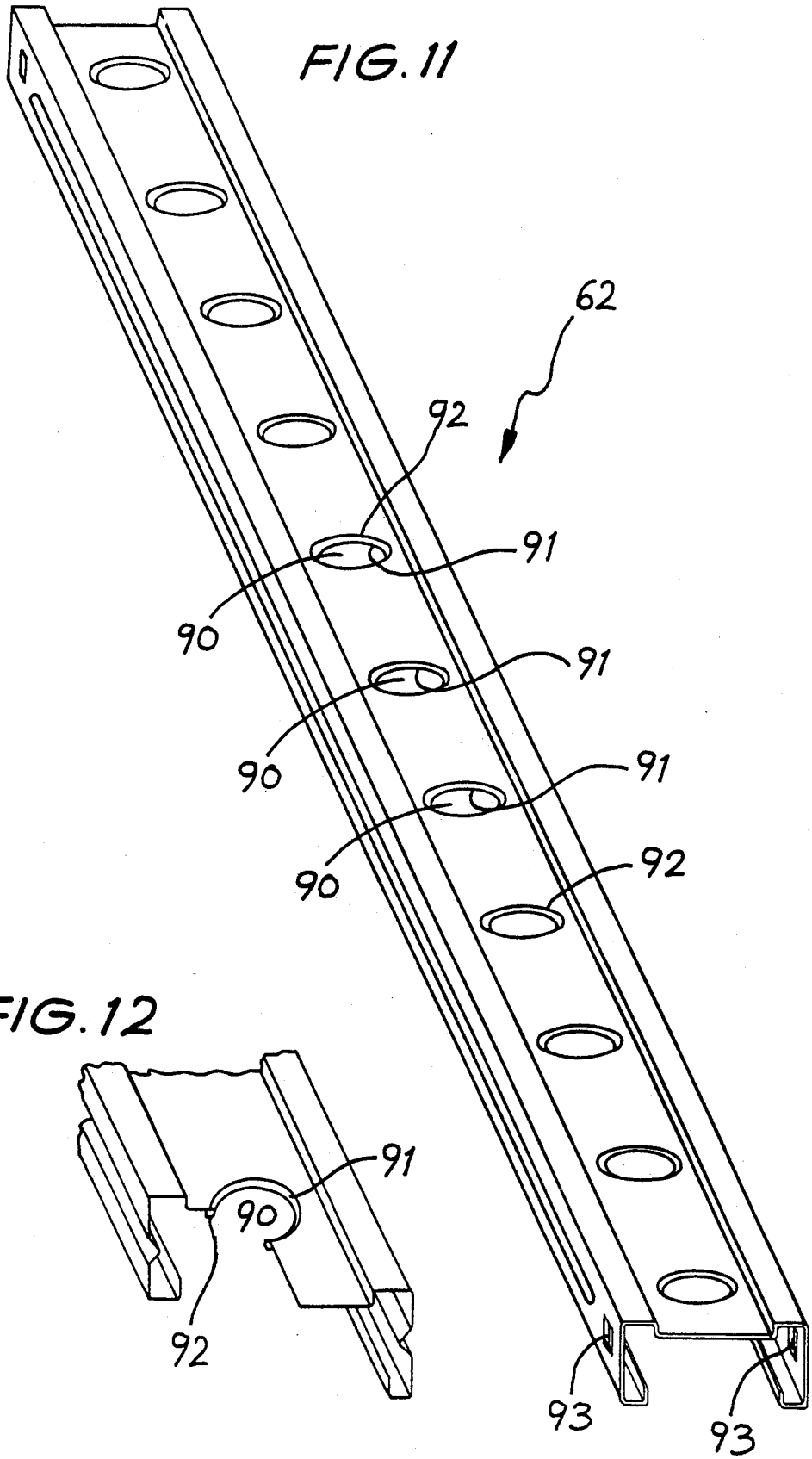
FIG. 11 is a schematic perspective view of a modification of the wall stud of FIG. 9.
FIG. 12 is a schematic part sectioned perspective view of the wall stud of FIG. 11.

In FIGS. 3 and 4 there is schematically depicted a wall stud 30 which is a rolled metal channel member of generally "C-shaped" transverse cross section so as to have a longitudinally extending base 31 and a pair of longitudinally extending side flanges 32. The base 31 has a longitudinally extending rib 33, which in turn is provided with a plurality of transversely extending longitudinally spaced ribs 34. Still further, the base 31 is provided with a plurality of apertures 35. Each of the apertures is surrounded by an annular reinforcement 36 (best seen in FIGS. 5 and 6). Each annular reinforcement 36 is provided by a lip 37 which is the material of the base 31 bent back upon itself. The annular reinforcements 36 and ribs 34 inhibit buckling of the base 31. The apertures 35 also enable the installation of electrical wiring and their service items.

Each of the side flanges 32 has a longitudinally extending rib 37 and is provided at its longitudinal end with a generally "L-shaped" lip 38. Each lip 38 includes a longitudinally extending first portion 39 extending generally parallel to the base 31, and a longitudinally extending second portion 40 extending generally parallel to the side flange 32.

To extend between the side flanges 32, in order to inhibit buckling by movement of the flanges 32 toward or away from each other, there is provided a plurality of clips 41. The clips 41 are located at intervals spaced longitudinally of the stud 30. Each clip 41 is formed of pressed metal, and includes a central body 42 which extends generally between the flanges 32, and has a pair of reinforcing flanges 43. The central body portion 42 terminates at each end with clip end portions 44. Each end portion 44 includes an "L-shaped" abutment 45 providing an abutment flange 46 which engages the outer surface 47 of the associated side flange 32. Punched from the central body portions 32 are a pair of clip tangs 48. Each tang 48 includes a base 49 and a head 50. The base 49 is resiliently deformable so that the head 50 is resiliently deflectable to allow the associated portion 40 to pass between the tang 49 and flange 46. Each base 49 is spaced from its associated flange 46 by a distance corresponding to the width of the portion 20 so that the portion 20 is securely located therebetween.

The apertures 35 may also be used to secure in position noggins which engage over the lip 37.

In FIG. 7 there is schematically depicted the joint 10. In this preferred embodiment, the joint 10 is reinforced by a reinforcing bracket 51. The reinforcing bracket 51 is formed from a piece of sheet metal so as to have a central portion 52 and two end flanges 53. The flanges 53 are generally perpendicular to the central portion 52. The central portion 52 is provided with an aperture 54 having a central neck 55 and two end portions 56. The apertures 54 are located between two legs 57 extending between the two end flanges 53. Each of the legs 57 has an L-shaped flange 58. Each flange 58 has a lip 59 extending generally normal to the plane of the legs 57.

In use of the above described reinforcing bracket 51, the flanges 53 abut the flanges 14 of the wall plate 11, to inhibit deflecting of the flanges 14 apart when stressed. The wall stud 12 is also reinforced by engagement of the L-shaped flanges 57 within the recess 17, and abutment with the portions 21 of the lips 19. The flanges 57 prevent inward deflection of the lips 19 and reinforce the base portions 15. By engaging the longitudinally extending surfaces 60.

The bracket 51 is a "snug fit" with respect to the wall plate 11 and stud 12 so as to reinforce the joint 10 to enable it to withstand higher stresses, as may be expected during an earthquake or cyclone.

In FIGS. 9 to 12 of the accompanying drawings there is schematically depicted a joint 60 between a bottom wall plate 61 and a wall stud 62 of a metal frame structure.

The bottom wall plate 61 is a rolled metal channel member of generally "U-shaped" transverse cross section so as to have a longitudinally extending base 63 and a pair of longitudinally side flanges 64. The stud 62 is also a rolled metal channel member. The stud 62 is of a "C-shaped" transverse cross section so as to have a base 65 and a pair of longitudinally extending side flanges 66. The base 65 has a longitudinally extending central recess defining portions 67, while the side flanges 66 are each provided with a longitudinally extending rib 68. Each of the side flanges 66 terminates at its longitudinally extending edge with an "L-shaped" lip 69. Each lip 69 has a first longitudinally extending portion 70 generally parallel to the base 65, and a second longitudinally extending portion 71 extending generally parallel to the side flanges 66.

Each of the wall plate side flanges 64 is provided with a plurality of projections 72 which are equally longitudinally spaced and project transversely towards the opposite flange 64. Each projection 62 is required within a corresponding recess 93 in the lower end of the wall stud 12.

The longitudinally extending edge portions 73 of the side flanges 64, include longitudinally extending lips 74 which are generally horizontally extending and terminate with horizontally facing edges 75. By having the edges 75 horizontally extending, vertically facing dangerous edges are avoided.

The lips 74 are regularly notched so as to provide notches 76. As one example, the portion of the lip forming the notch 76 may be removed, or left to extend vertically so as to provide an upwardly extending portion 77. Accordingly the lips 73 provide lip segments 78 having end edges 79. The end edges 79 abut the wall stud 62 to aid in retaining the wall stud 62 in position. This particular configuration is particularly resistant in respect of shear forces.

To further enhance connection between the wall stud 62 and the bottom wall plate 61, there is provided the reinforcing bracket 51 described with reference to FIGS. 7 and 8. This connection is further enhanced by engagement of the wall stud 62 in the notch 76 via abutment with the end edges 79.

The wall stud 62 may also be provided with a plurality of apertures 90, with each aperture being surrounded by an annular reinforcement 91. Each annular reinforcement 91 is provided with a lip 92 which is the material of the base 65 bent back upon itself. The annular reinforcement 91 inhibits buckling of the base 65. The apertures 90 may also be used to enable the installation of electrical wiring and other service items. Still further, the apertures 85 may enable the securing in position of "noggin". This would be achieved by engagement of the noggins over the lips 92.

What is claimed is:

1. A clip for a metal wall stud, which wall stud consists of a rolled metal member of generally "C-shaped" transverse cross section so as to have a longitudinally extending base and a pair of longitudinally extending side flanges, said clip being adapted to extend between the side flanges to inhibit movement therebetween in a direction transverse of the wall stud, said clip comprising a central portion to extend generally between the flanges, and a pair of clip ends, each clip end being adapted to engage one of the flanges and having an abutment to engage its respective flange to inhibit transverse movement thereof in a direction toward the other flange, and the central portion comprising at least one tang which is resiliently deformable so as to be biased into engagement with a respective one of the stud flanges.

2. The clip of claim 1, wherein:

the tangs are punched from the central portion.

3. The clip of claim 1, wherein:

the central portion further comprises at least one reinforcement flange.

4. The clip of claim 2, wherein, the central portion further comprises at least one reinforcement flange.

5. The clip of claim 3, wherein:

the reinforcement flange is folded from the central portion and extends between the stud flanges when in use.

6. The clip of claim 4, wherein:

the reinforcement flange is folded from the central portion and extends between the stud flanges when in use.

* * * * *